US012385207B2

(12) United States Patent
Eicher

(10) Patent No.: US 12,385,207 B2
(45) Date of Patent: Aug. 12, 2025

(54) CORROSION PROTECTION DEVICE, CORROSION PROTECTION SYSTEM, CORROSION-PROTECTED EMBANKMENT STABILIZATION SYSTEM, AND METHOD FOR CORROSION-PROTECTED ANCHORING OF A GEOTECHNICAL ANCHOR ELEMENT

(71) Applicant: Geobrugg AG, Romanshorn (CH)

(72) Inventor: Manuel Eicher, Winden (CH)

(73) Assignee: Geobrugg AG, Romanshorn (CH)

( * ) Notice: Subject to any disclaimer, the term of this patent is extended or adjusted under 35 U.S.C. 154(b) by 214 days.

(21) Appl. No.: 18/255,894

(22) PCT Filed: Nov. 30, 2021

(86) PCT No.: PCT/EP2021/083533
§ 371 (c)(1),
(2) Date: Jun. 5, 2023

(87) PCT Pub. No.: WO2022/122468
PCT Pub. Date: Jun. 16, 2022

(65) Prior Publication Data

US 2024/0044096 A1 Feb. 8, 2024

(30) Foreign Application Priority Data

Dec. 10, 2020 (DE) ..... 10 2020 132 950.4

(51) Int. Cl.
*E02D 5/80* (2006.01)
*E02D 17/20* (2006.01)

(52) U.S. Cl.
CPC ..... *E02D 5/801* (2013.01); *E02D 2300/0029* (2013.01)

(58) Field of Classification Search
CPC ... E21D 21/0013; E02D 17/202; E02D 5/801; E02D 31/06
See application file for complete search history.

(56) References Cited

U.S. PATENT DOCUMENTS 4,302,131 A 11/1981 Brown
4,354,773 A 10/1982 Noack
(Continued)

FOREIGN PATENT DOCUMENTS

AU 578850 B2 11/1988
AU 2010206027 A1 2/2011
(Continued)

OTHER PUBLICATIONS

Office Action dated Oct. 1, 2024 issued for the corresponding Japanese Patent Application No. 2023-535382 (and English translation).

(Continued)

*Primary Examiner* — Amber R Anderson
*Assistant Examiner* — Stacy N Lawson
(74) *Attorney, Agent, or Firm* — Posz Law Group, PLC

(57) ABSTRACT

A corrosion protection device, in particular a corrosion protection adapter, at least for a protection against corrosion at least of an end region of a geotechnical anchor element, which is in particular realized of a corrosion-sensitive metal or of a corrosion-sensitive metal alloy, for example of a construction steel or a concrete steel, includes at least one sleeve element which is configured at least for a mounting on the geotechnical anchor element, encompassing the end region of the geotechnical anchor element at least in a circumferential direction of the geotechnical anchor element, wherein the sleeve element is made at least largely of a corrosion-resistant metal and includes at least an outer thread.

16 Claims, 5 Drawing Sheets

(56) References Cited

U.S. PATENT DOCUMENTS

Figure 1:
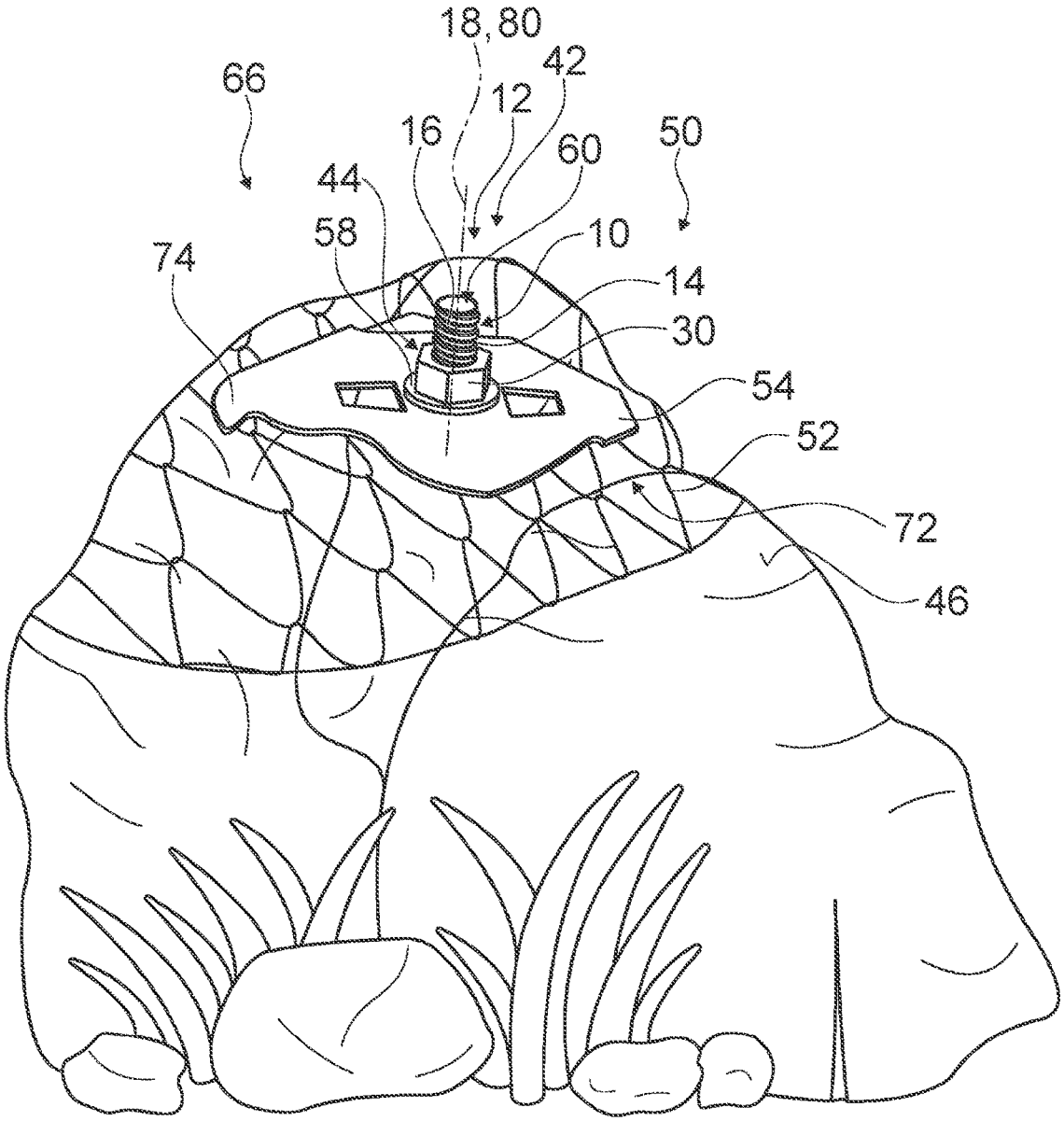

| | | | | |
|---|---|---|---|---|
| 4,630,971 | A | 12/1986 | Herbst et al. | |
| 5,788,398 | A | 8/1998 | Sorkin | |
| 9,512,868 | B2 | 12/2016 | Stempniewski et al. | |
| 2011/0070034 | A1 | 3/2011 | Schmidt | |
| 2013/0149042 | A1* | 6/2013 | Steyn | E21D 21/0033 405/259.3 |
| 2014/0308081 | A1* | 10/2014 | Clingan | E21D 21/008 405/259.1 |
| 2019/0292737 | A1* | 9/2019 | Arita | E01F 7/045 |
| 2021/0222725 | A1* | 7/2021 | Yang | F16B 39/06 |

FOREIGN PATENT DOCUMENTS

| | | | | |
|---|---|---|---|---|
| CA | 2651242 | A1 | 7/2009 | |
| CH | 640306 | A5 | 12/1983 | |
| DE | 6601215 | U | 3/1969 | |
| DE | 3320460 | C1 | 10/1984 | |
| DE | 4211334 | C1 | 9/1993 | |
| DE | 102018125782 | A1 | 4/2020 | |
| EP | 0015426 | A1 | 9/1980 | |
| EP | 0059070 | A1 | 9/1982 | |
| EP | 0060053 | B1 | 9/1982 | |
| EP | 0190460 | A1 | 8/1986 | |
| ES | 1017336 | U | 12/1991 | |
| GB | 2141804 | A | 1/1985 | |
| JP | H0881956 | A | 3/1996 | |
| JP | H11-193526 | A | 7/1999 | |
| JP | 2015229861 | A | 12/2015 | |
| JP | 2018204191 | A | 12/2018 | |
| KR | 20060036673 | A | 5/2006 | |
| KR | 2007038268 | A * | 4/2007 | E02D 5/801 |
| WO | 94/05900 | A1 | 3/1994 | |
| WO | 2012/071625 | A1 | 6/2012 | |
| WO | 2013/141047 | A1 | 9/2013 | |

OTHER PUBLICATIONS

Office Action dated Oct. 15, 2024 issued for the corresponding Chilean Patent Application No. 202301504 (and English translation).

Office Action dated Oct. 21, 2024 issued for the corresponding Canadian Patent Application No. 3,201,742.

German Search Report mailed Sep. 8, 2021 in the corresponding German Patent Application No. 102020132950.4 (and English machine translation).

International Search Report of the International Searching Authority mailed Mar. 21, 2022 for the corresponding International Application No. PCT/EP2021/083533 (and English translation).

Australian Examination Report dated May 22, 2024 issued for the corresponding Australian Patent Application No. 2021394550.

Office Action dated Jun. 18, 2024 issued for the corresponding Japanese Patent Application No. 2023-535382 (and English translation).

Opposition of Jan. 5, 2024 in the corresponding Chilean Patent Application No. 202301504 (and English machine translation).

Pawan R. Gupta, "Chapter 3: Post-Tensioning Systems" in Post-Tensioning Manual, Post-Tensioning Institute, 2006, 6th edition, pp. ii-iv, 59-63.

Excerpts from "Soil Nailing Field Inspectors Manual," U.S. Department of Transportation Federal Highway Administration, Apr. 1994, pp. 11-14, 27-28.

Indonesian Office Action of Jan. 30, 2025 issued in corresponding Indonesian Patent Application No. P00202305921.

Korean Office Action of Feb. 4, 2025 issued in corresponding Korean Patent Application No. 10-2023-7023392 (and English translation attached).

Brazilian Office Action mailed on Mar. 6, 2025 issued in Brazilian Patent Application No. 112023009450-0 (and English translation attached).

* cited by examiner

CORROSION PROTECTION DEVICE, CORROSION PROTECTION SYSTEM, CORROSION-PROTECTED EMBANKMENT STABILIZATION SYSTEM, AND METHOD FOR CORROSION-PROTECTED ANCHORING OF A GEOTECHNICAL ANCHOR ELEMENT

CROSS REFERENCE TO RELATED APPLICATIONS

This application is a U.S. national stage application of PCT/EP2021/083533 filed on Nov. 30, 2021, which claims priority from and incorporates herein by reference the German patent application DE 10 2020 132 950.4 filed on Dec. 10, 2020.

PRIOR ART

The invention relates to a corrosion protection device, to a corrosion protection system, to a corrosion-protected embankment stabilization system and to a method for corrosion-protected anchoring of a geotechnical anchor element.

It has already been proposed that geotechnical anchor elements be produced completely of stainless steel (see DE 33 20 460 C1 or EP 0 060 053 B1). However, geotechnical anchor elements of this kind are quite expensive in comparison to ordinary construction-steel anchors. As a further known alternative to construction-steel anchors there are geotechnical anchor elements made of metallized fiber glass (see AU 2010206027 A1). However, geotechnical anchor elements of this kind have, on the one hand, less positive shearing characteristics than metal anchors and are, on the other hand, not fireproof, which means that they may lose their anchoring effect in the case of wood fires or the like. Moreover, plastic caps are already known, which are put over end regions of installed geotechnical anchor elements (see CA 2 651 242 A1), in particular in view of typical planning requirements in the field of natural hazards for at least 100-year durability, these do not offer sufficient permanent protection from corrosion as the plastic gets weathered and brittles over time, then allowing, for example, entry of water.

The objective of the invention is in particular to provide a generic device with advantageous corrosion protection properties, in particular with regard to a protection of installed geotechnical anchor elements. The objective is achieved according to the invention.

Advantages of the Invention

The invention is based on a corrosion protection device, in particular a corrosion protection adapter, at least for a protection against corrosion at least of an end region of a geotechnical anchor element, which is in particular realized of a corrosion-sensitive metal or of a corrosion-sensitive metal alloy, e. g. a construction steel or a concrete steel, with at least one sleeve element which is configured at least for a mounting on the geotechnical anchor element, encompassing the end region of the geotechnical anchor element at least in a circumferential direction of the geotechnical element.

It is proposed that the sleeve element is made at least largely of a corrosion-resistant metal, preferably a mechanically stable and at the same time corrosion resistant metal, and comprises at least an outer thread, which in particular extends at least over a large portion of a total length of the sleeve element. As a result, advantageous corrosion protection properties are achievable, in particular with regard to a protection of an installed geotechnical anchor element against corrosion. Advantageously particularly favorable and particularly long-lived corrosion protection, in particular of an end region of an anchor element installed in a ground and protruding from the ground, is achievable. It is advantageously possible to attain particularly favorable and particularly long-lived corrosion protection at the same time as costs that are as low as possible.

Advantageously cost-efficient corrosion protection for a geotechnical anchor element is achievable. It is advantageously possible to attain subsequently-installed corrosion protection which is particularly favorable and particularly long-lived and which fully preserves a functionality of the geotechnical anchor element; such that, for example, screwing a fixing nut onto the end region of the geotechnical anchor element is still possible without change. Advantageously constant full load-bearing capacity is attainable even subsequently to the establishment of the corrosion protection.

Advantageously simple and fast production of a reliable corrosion protection is enabled. It is advantageously possible to attain a high mechanical stability of the corrosion protection, for example against impacts, e. g. with respect to impacts of rocks falling onto the end region of the geotechnical anchor element.

By a "corrosion protection device" is in particular a device to be understood which slows down and/or at least substantially prevents a corrosion or a weathering, in particular a measurable change of a material of the geotechnical anchor element, having a negative effect on a functionality of the geotechnical anchor element, for example a strength of the geotechnical anchor element or a tenacity of the geotechnical anchor element, preferably a decomposition of a metal of the geotechnical anchor element caused by oxidation. A "corrosion protection adapter" is in particular to mean an object, preferably an object realized separately from the geotechnical anchor element, which is configured, by its installation at the geotechnical anchor element, to augment a corrosion resistance of the geotechnical anchor element, wherein full functionality of the geotechnical anchor element is preserved at the same time, which means for example that a possibility of screwing a nut onto the geotechnical anchor element protected by the corrosion protection adapter remains at least substantially uninfluenced and/or at least substantially unaffected in comparison to the geotechnical anchor element without a corrosion protection adapter. By an "end region" of a geotechnical anchor element is in particular a region to be understood that comprises a front-face end of the geotechnical anchor element as well as maximally 30%, preferably maximally 20% and preferentially maximally 10% of a subregion of the anchor element continuously adjoining the front-face end. In particular, the end region is realized at least as that portion of the geotechnical anchor element which is composed of a first subregion of the geotechnical anchor element, which is configured to protrude from the installation ground after installation, and an adjoining second subregion, which has at least %, preferably at least 50%, preferentially at least 100% and particularly preferably maximally 300% of a longitudinal extent of the first subregion.

A "geotechnical anchor element" is in particular to mean a rock anchor, a rocknail, a groundnail, a rod anchor, a strand anchor, in particular a cable anchor with an outer thread, like the one described for example in the patent application DE 10 2018 125 782 A1, or something like that. By a "corrosion-sensitive metal" is in particular a metal, preferably a metal alloy, to be understood which differs from a stainless steel and differs from a superalloy, like for example Inconel, Incoloy, Hastelloy, Cronifer, Nicrofer or the like. A "stainless steel" is in particular to mean a steel with a chrome content of at least 10.5%, the chrome content being preferably dissolved in an austenitic solid solution or in a ferritic solid solution.

A "sleeve element" is in particular to mean a sleeve-shaped, preferably tube-shaped, solid elongate element, which encompasses an inner space at least in a circumferential direction and preferably at least partially in at least one longitudinal direction as well. Preferably a sleeve element is to be understood as an end-sleeve-shaped element and/or as a sleeve-cap-shaped element, which forms at least on a front face a longitudinal abutment for an element that is inserted in the sleeve element and fills the sleeve element at least largely, for example for the geotechnical anchor element. Preferably the sleeve element is configured, in a state when mounted correctly, to fully encompass the end region of the geotechnical anchor element, in particular at least in the circumferential direction of the geotechnical anchor element. In the state when mounted correctly, the geotechnical anchor element in particular protrudes from the sleeve element only on one of the two front faces of the sleeve element. In particular, the sleeve element is configured to be arranged on one of the ends of the geotechnical anchor element, in particular on the end of the geotechnical anchor element that protrudes from the ground in the installed state of the geotechnical anchor element. The term "encompass" is preferably to mean "encompass all around" and/or "encompass by 360°". Preferably, when being mounted on the geotechnical anchor element, the sleeve element is screwed onto the geotechnical anchor element. "Configured" is in particular to mean specifically designed and/or equipped. By an object being configured for a certain function is in particular to be understood that the object fulfills and/or carries out said certain function in at least one application state and/or operation state.

In particular, while the mounted sleeve element covers only a subregion of the geotechnical anchor element, this subregion is in an installed (anchored) state of the geotechnical anchor element the only portion of the geotechnical anchor element that is directly exposed to weather conditions, such that protection of this portion of the geotechnical anchor element preferably allows achieving protection of the entire geotechnical anchor element against corrosion. In particular, the sleeve element is configured to keep corrosively-acting influences, for example atmospheric influences, away from the geotechnical anchor element. In particular, the sleeve element is configured to form a surface with respect to corrosively-acting influences, for example atmospheric influences. A "large portion" and/or "largely" are in particular to mean 51%, preferably 66%, preferentially 75%, particularly preferably % and especially preferentially 95%. Preferably a sleeve element that is made at least largely of a corrosion-resistant metal differs from a corrosion protection coating (for example a zinc coating, a ZnAl coating, a corrosion protection varnish, or the like) and/or differs from a sleeve element that is made of a corrosion-sensitive metal and is coated with a corrosion protection layer. "Mechanical stability" is in particular to mean a resistance against deformations by slight impacts or by a self-weight. The sleeve element is in particular realized in a flexurally rigid manner.

A "corrosion-resistant metal" is in particular to mean a stainless steel or a superalloy, like for example Inconel, Incoloy, Hastelloy, Cronifer, Nicrofer or the like. In particular, the outer thread is wound around the surface of the sleeve element in the circumferential direction. In particular, the outer thread is formed directly by the surface of the sleeve element. In particular, the outer thread extends over an entire longitudinal extent of the sleeve element. It is conceivable that, analogously to typical construction-steel bars or concrete-steel bars (thread steel bars), the outer thread is interrupted on two sides. The outer thread is in particular configured for a screwing-on of a nut, in particular a clamping nut for the geotechnical anchor element. In particular, the sleeve element and/or the outer thread has a constant and/or consistent diameter, in particular outer diameter, along a longitudinal direction of the sleeve element.

It is further proposed that the sleeve element is realized as a cap that is at least partially, preferably completely, closed in a longitudinal direction of the sleeve element. This advantageously allows attaining particularly favorable and particularly long-lived corrosion protection, in particular of an end region of an anchor element installed in a ground, which protrudes from the ground. Advantageously, entry of water into an interstice between the sleeve element and the geotechnical anchor element can be prevented. It is advantageously possible to comprehensively insulate the geotechnical anchor element from the surrounding atmosphere. Advantageously simple installation of the sleeve element on the geotechnical anchor element is achievable. In particular, the at least partially closed cap forms the longitudinal abutment for the geotechnical anchor element. By the sleeve element being realized as a "partially closed cap" is in particular to be understood that the sleeve element is realized in such a way that in a state when mounted on the geotechnical anchor element, an end of the sleeve element covers and/or screens at least a portion of a front face of the geotechnical anchor element, preferably at least 20%, preferentially at least 40% and particularly preferentially at least 66% of the geotechnical anchor element, in a viewing direction extending along the longitudinal direction. In particular, the longitudinal direction is at least substantially orthogonal to the front face of the geotechnical anchor element, A completely closed cap in particular closes the front face of the geotechnical anchor element completely in the longitudinal direction. A "cap" is in particular to mean a closely-fitting closure for the end region of the geotechnical anchor element, which is preferably realized separately from the geotechnical anchor element, It is moreover proposed that the sleeve element comprises an inner thread. This advantageously allows achieving particularly favorable and/or particularly close fitting of the sleeve element on the geotechnical anchor element, thus enabling particularly favorable and particularly long-lived corrosion protection. Advantageously this facilitates screwing the sleeve element onto the geotechnical anchor element, thus enabling particularly simple and failure-proof mounting. In particular, the inner thread is wound around an inner surface of the sleeve element in the circumferential direction. In particular, the inner thread is formed directly by a surface of the sleeve element. In particular, the inner thread extends over an entire longitudinal extent of the sleeve element. It is conceivable that, analogously to typical construction-steel bars or concrete-steel bars (thread steel bars), the inner thread is interrupted on two sides and is in particular formed so as to be round, respectively tube-shaped, between the interruptions. The inner thread is in particular configured for a screwing of the sleeve element onto the geotechnical anchor element, which often has a construction-steel thread or a rebar thread. In particular, the inner thread has a constant and/or consistent diameter, in particular inner diameter, along a longitudinal direction of the sleeve element. In particular, the inner thread and the outer thread have at least substantially identical thread runs, preferably at least substantially identical thread pitches, thread directions, thread forms and/or thread depths. "Substantially identical" is in particular to mean identical but for manufacturing tolerances. However, it is alternatively also conceivable that the inner thread and the outer thread differ at least with respect to their thread pitches, thread directions, thread forms and/or thread depths. Preferably the inner thread is realized as a left-handed thread. However, alternatively an implementation of the inner thread as a right-handed thread is also conceivable. Preferably the outer thread is realized as a left-handed thread. However, alternatively an implementation of the outer thread as a right-handed thread is also conceivable.

It is further proposed that the inner thread in particular comprises a thread crest and that the outer thread in particular comprises a thread groove, wherein the thread crest of the inner thread at the same time forms the thread groove of the outer thread (and vice versa). Preferably all thread crests of all inner threads at the same time form all thread grooves of all outer threads (and vice versa). This advantageously enables particularly favorable and/or effective force transfer of a nut screwed on the sleeve element on the outside to the geotechnical anchor element. It is advantageously achievable that the sleeve element has an at least substantially constant wall thickness. "At least substantially constant" is in particular to mean with a fluctuation range of less than 3%, preferably of less than 5% and preferentially of less than 10% of an average value. In particular, the wall thickness of the sleeve element is at least 1 mm, preferably at least 2 mm, advantageously at least 3 mm, preferentially at least 4 mm and particularly preferably at least 5 mm. In particular, a tip of the thread crest of the inner thread points towards an interior of the sleeve element. In particular, a tip of a thread crest of the outer thread points in a direction away from the interior of the sleeve element. In particular, a bottom of a thread groove of the inner thread points in the direction away from the interior of the sleeve element. In particular, a bottom of the thread groove of the outer thread points toward the interior of the sleeve element.

In addition, it is proposed that the inner thread of the sleeve element and/or the outer thread of the sleeve element are/is realized as (a) thread(s) having a coarse thread pitch of more than 5 mm, preferably more than 7 mm, advantageously more than 9 mm, especially advantageously more than 12 mm, preferentially more than 15 mm and particularly preferably less than 21 mm. This allows attaining advantageous mounting and tightness properties. In particular, the inner thread of the sleeve element and/or the outer thread of the sleeve element are/is realized as a glide thread, preferably a round thread, preferentially a metrical round thread having a coarse pitch. It is in particular conceivable that the inner thread of the sleeve element and/or the outer thread of the sleeve element are/is realized as a pipe thread for a connection to the geotechnical anchor element where pressure-tight joints are made on the thread. In particular, a thread having a thread profile slightly differing from a completely round and/or from an evenly rounded thread profile, being for example slightly asymmetrical, is also considered as a round thread in the meaning of the present disclosure. Alternatively the inner thread of the sleeve element and/or the outer thread of the sleeve element may also be realized as a trapezoid thread with the coarse thread pitch or as a rounded trapezoid thread with the coarse thread pitch. In particular, the geotechnical anchor element has an outer thread. In particular, a thread pitch, a thread direction and/or a thread form of the inner thread of the sleeve element is at least substantially complementary to a thread pitch, a thread direction and/or a thread form of the outer thread of the geotechnical anchor element. In particular, the inner thread of the sleeve element is configured for a mutual engagement with an outer thread of the geotechnical anchor element and/or with thread ribs of the geotechnical anchor element. In particular, the inner thread of the sleeve element is configured to be screwed onto the outer thread of the geotechnical anchor element and/or onto the thread ribs of the geotechnical anchor element. In particular, a thread pitch, a thread direction and/or a thread form of the outer thread of the sleeve element corresponds at least substantially to a thread pitch, a thread direction and/or a thread form of the outer thread of the geotechnical anchor element. In particular, the outer thread of the sleeve element and the outer thread of the geotechnical anchor element are realized at least substantially identically to each other except for their diameters. Preferably the thread pitch is calculated as a distance between two neighboring maxima, in particular thread crests, of a thread turn, in the longitudinal direction of the sleeve element.

Beyond this it is proposed that the sleeve element is designed for a force transfer between a nut that is screwed onto the outer thread of the sleeve element, in particular the corrosion protection device, and the geotechnical anchor element. This advantageously allows achieving particularly favorable and particularly long-lived subsequently-installed corrosion protection, which preserves a functionality of the geotechnical anchor element completely. Advantageously, also after an establishment of the corrosion protection, a constant full load-bearing capacity is achievable. In order to obtain said force transfer, a particularly close fit is provided between the inner thread of the sleeve element and the outer thread of the geotechnical anchor element. In particular, such a force transfer is made impossible by a protective paint and/or varnishing and/or by a protective coating, e. g. a galvanization. Paint coats, coatings and/or varnishings are often damaged when the nut is screwed on or in an impact event or shock event, thus losing their protective effect with respect to corrosion. In particular, the sleeve element is made of a metal, preferably of a steel, having a tensile strength of at least 250 $N/mm^2$, preferably of at least 400 $N/mm^2$ and preferentially of at least 600 $N/mm^2$.

If the sleeve element is made at least largely, preferably completely (besides, as the case may be, an optional coating or paint coat) of a stainless steel, in particular of a stainless special steel (also: rust-resistant steel or non-rusting steel), advantageous corrosion protection characteristics are achievable, in particular with regard to a protection of an installed geotechnical anchor element against corrosion. In particular, the sleeve element is made of a stainless steel having a material number according to the standard DIN EN 10027-2:2015-07, which is between 1.4001 and 1.4462, for example of a stainless steel having the DIN EN 10027-2: 2015-07 material number 1.4301, 1.4571, 1.4401, 1.4404 or 1.4462.

Furthermore, it is proposed that the sleeve element is realized in a one-part implementation, preferably a monolithic implementation. In this way high level of tightness of the sleeve element and thus particularly favorable corrosion protection is achievable. Moreover, simple handling and/or simple installation are/is advantageously facilitated. "In a one-part implementation" is in particular to mean formed in one piece. This one piece is preferably produced from a single blank, a mass and/or a cast, particularly preferably in a sheet-bending procedure. However, it is alternatively conceivable that the sleeve element is produced at least in a two-part or in a multi-part implementation, for example from two interconnected half-shells or from a pipe element and a cover part closing the pipe element in the longitudinal direction.

If the sleeve element is a prefabricated component realized separately from the geotechnical anchor element, advantageously a simple installation is enabled. This also advantageously allows providing a plurality of different kinds and types of geotechnical anchor elements with the corrosion protection device. Advantageously a high degree of flexibility is achievable. It is moreover advantageously possible to keep material input and/or total costs low. In particular, the sleeve element differs from a paint coat of the geotechnical anchor element, from a varnishing of the geotechnical anchor element, from a coating of the geotechnical anchor element and/or from a covering of the geotechnical anchor element with a flexible material, e. g. a (plastic or metal) film. It is conceivable that the sleeve element is implemented of a stainless-steel sheet pressed onto the geotechnical anchor element but preferentially the sleeve element is implemented differently from a stainless-steel sheet pressed onto the geotechnical anchor element.

It is also proposed that an inner space of the sleeve element is at least partially filled with a deformable sealing mass. This advantageously allows achieving particularly high tightness of the sleeve element, in particular with respect to a contact of the geotechnical anchor element with water and/or with air. Advantageously, particularly effective and/or particularly long-lived corrosion protection are/is attainable. In particular, the deformable sealing mass may be realized as a grease, for example lubricating grease, or as a sealing agent. In particular, the deformable sealing mass is realized as a semifluid, viscous material. It is conceivable that the deformable sealing mass is made of a curable material, like for example cement paste. In particular, the inner space of the sleeve element is realized as a receiving space of the sleeve element for arranging the geotechnical anchor element. In particular, in the state when the sleeve element is mounted on the geotechnical anchor element, an interstice between the sleeve element and the geotechnical anchor element is filled with the deformable sealing mass.

Alternatively or additionally it is proposed that an inner space of the sleeve element is at least partially filled with a deformable adhesive mass. This advantageously allows achieving particularly high tightness of the sleeve element. Is is advantageously possible to attain particularly effective and/or particularly long-lived corrosion protection. Moreover, advantageously a particularly favorable force transfer is achievable between the nut screwed that is screwed onto the outer thread of the sleeve element and the geotechnical anchor element. In particular, the deformable adhesive mass creates in the mounted state a substance-to-substance adhesive bond between the sleeve element and the geotechnical anchor element. Preferably the adhesive mass is viscous at first and hardens after the mounting while creating the substance-to-substance bond. In particular, in the state when the sleeve element is mounted on the geotechnical anchor element, the interstice between the sleeve element and the geotechnical anchor element is filled with the deformable adhesive mass. In particular, the adhesive mass may at the same time be the sealing mass or vice versa.

Beyond this it is proposed that the sleeve element is mountable, in particular screwable, onto the geotechnical anchor element without a tool. This advantageously enables particularly simple and/or cost-efficient mounting. In particular, the sleeve element can be screwed manually onto the geotechnical anchor element, in particular onto the outer thread or onto the thread ribs of the geotechnical anchor element. In particular, the sleeve element can be screwed onto the geotechnical anchor element on-site during a mounting of the geotechnical anchor element. However, alternatively it is also conceivable that the sleeve elements are pre-mounted on the geotechnical anchor elements before a mounting of the geotechnical anchor elements.

In addition, it is proposed that the sleeve element has a wall thickness that is equivalent to at least 1.2%, preferably to at least 2.5%, advantageously to at least 3.5%, preferentially to at least 5% and particularly preferably to maximally 15% of a maximal outer diameter of the sleeve element. In this way a high degree of stability of the sleeve element is advantageously achievable, which in particular results in advantageously preserving the corrosion protection also after an impact event, for example a rockfall event, that hits the sleeve element. In particular, the maximal outer diameter of the sleeve element is given by the thread crests of the outer thread of the sleeve element. In particular, the wall thickness of the sleeve element is equivalent to at least 30%, preferably at least 45% and preferentially at least 100% of a depth of a thread turn of the outer thread (distance, measured perpendicularly to the longitudinal direction of the sleeve element, between a thread crest and a thread groove of the outer thread of the sleeve element). In particular, a longitudinal extent of the sleeve element along the longitudinal axis is at least 300 mm, in particular at least 450 mm. In particular, the longitudinal extent of the sleeve element along the longitudinal axis is maximally 2,000 mm, preferably no more than 1,500 mm. In particular, the wall thickness of the sleeve element is at least 0.6 mm, preferably at least 1 mm, preferentially at least 1.5 mm and particularly preferentially no more than 3 mm. In particular, the outer diameter of the sleeve element is at least 16 mm, advantageously at least 20 mm, preferably at least 25 mm, preferentially at least mm and especially preferentially maximally 50 mm.

It is further proposed that the sleeve element has along the longitudinal direction a recurrent constant cross section. Preferably the outer thread of the sleeve element and/or the inner thread of the sleeve element have/has a constant cross section in the longitudinal direction, which in particular means that the diameters of the thread crests and the diameters of the thread grooves remain at least substantially constant along the longitudinal direction. This advantageously permits flexible cutting-to-length of the sleeve element to a desired length of the sleeve element, which is adapted to a certain geotechnical anchor element. In particular, the sleeve element, preferably the outer thread of the sleeve element and/or the inner thread of the sleeve element, are/is free of a tapering in the longitudinal direction and/or free of a widening in the longitudinal direction.

Furthermore, a corrosion protection system is proposed, with the corrosion protection device and with the geotechnical anchor element, which is in particular realized of the corrosion-sensitive metal. This advantageously enables an installation of the geotechnical anchor element, with a high level of corrosion protection.

It is also proposed that the corrosion protection device is mounted on the geotechnical anchor element in such a way that interstices between the sleeve element and the geotechnical anchor element are closed toward the environment in a water-tight manner and/or filled with the deformable sealing mass and/or with the deformable adhesive mass. This permits attaining advantageous corrosion protection characteristics, in particular with regard to a protection of an installed geotechnical anchor element against corrosion. Advantageously, cost-efficient corrosion protection for a geotechnical anchor element is achievable.

It is further proposed that the sleeve element is mounted on the geotechnical anchor element in such a way that, in a state of the geotechnical anchor element being anchored in a ground, a subregion of the sleeve element, in particular a subregion of the sleeve element that is arranged opposite the side of the sleeve element that is at least partially closed in a cap-like manner, is sunk in the ground. In this way particularly high tightness of the sleeve element is advantageously achievable, which allows preventing an entry of humidity or air into the interstice between the sleeve element and the geotechnical anchor element, thus enabling a high degree of corrosion protection. Advantageously, as a result of preventing an entry of humidity into the interstices, contact corrosion between the sleeve element and the geotechnical anchor element can be averted. In particular, the portion of the sleeve element that is sunk in the ground is mortared and/or concreted into the ground together with the geotechnical anchor element. In particular, the subregion of the sleeve element is sunk into the ground with its non-closed end region. In particular, the subregion of the sleeve element in which the geotechnical anchor element protrudes from the sleeve element is sunk into the ground.

If in the anchored state of the geotechnical anchor element at least a quarter, preferably at least a third, preferentially at least 50% and particularly preferably maximally 75% of a total longitudinal extent of the sleeve element is arranged so as to be sunk in the ground, an especially favorable corrosion protection effect is advantageously achievable.

Furthermore, a corrosion-protected embankment stabilization system is proposed, with the corrosion protection system anchored in a ground, with a wire netting made of high-tensile steel, with a clamping plate and with a nut, wherein the clamping plate is threaded into the geotechnical anchor element that is anchored in the ground and furnished with the sleeve element, and wherein—by means of the nut that is screwed onto the sleeve element—the clamping plate is pressed onto the wire netting in a longitudinal direction of the geotechnical anchor element such that the wire netting is fastened on the ground in an at least substantially positionally fixed manner. This advantageously allows achieving especially corrosion-protected and/or long-lived implementation of an embankment stabilization.

If moreover the clamping plate, the nut and/or the wire netting have/has at least a stainless steel surface or are/is completely made of the stainless steel, the geotechnical anchor element being made of a corrosion-sensitive metal or of a corrosion-sensitive metal alloy, in particular of a construction steel, a high level of corrosion protection of the entire embankment stabilization system is achievable in spite of cost-efficient standard anchor elements being used.

Beyond this, a method is proposed for a corrosion-protected anchoring of the geotechnical anchor element which is made of the corrosion-sensitive metal or of the corrosion-sensitive metal alloy, in particular of the construction steel, wherein in at least one method step the sleeve element, which is at least largely made of the corrosion-resistant, preferably mechanically stable and corrosion-resistant, metal and comprises the outer thread, is mounted in the end region of the geotechnical anchor element, wherein in at least one further method step the sleeve element gets closed toward the environment in a humidity-tight manner, and wherein in at least one further method step the geotechnical anchor element is brought into the ground in such a way that at least a subregion of the sleeve element that is mounted on the geotechnical anchor element is sunk into the ground, in particular mortared into the ground. This advantageously allows an installation of the geotechnical anchor element that is made of the corrosion-sensitive metal, which provides a high degree of corrosion protection.

In addition, it is in particular proposed that the sleeve element is produced as a flute tube. Alternatively it is proposed that the sleeve element is produced by re-forming, in particular by pressing onto a mold or by blowing into a mold. Alternatively it is proposed that the sleeve element is produced by deep-drawing.

Moreover, it is in particular proposed that the corrosion protection system is configured to be used for static and/or dynamic loads, including impact stress. Conceivable exemplary applications of the corrosion protection system are applications as adapters for rocknails, for example in a rock stabilization, as adapters for loose-rock anchors, for example in an embankment stabilization, as adapters for foundation anchors, for example for rockfall barriers or pedestrian bridges, as adapters for anchors in a context of mining applications and/or tunnel construction, and/or as adapters for tensioning and/or connection elements in constructions, for example in a context of roof constructions and/or glass facades.

The corrosion protection device according to the invention, the corrosion protection system according to the invention, the corrosion-protected embankment stabilization system according to the invention and the method according to the invention are herein not to be limited to the application and implementation described above. In particular, in order to fulfill a functionality that is described here, the corrosion protection device according to the invention, the corrosion protection system according to the invention, the corrosion-protected embankment stabilization system according to the invention and the method according to the invention may have a number of individual elements, components, method steps and units that differs from a number given here.

DRAWINGS

Further advantages will become apparent from the following description of the drawings. In the drawings an exemplary embodiment of the invention is illustrated. The drawings, the description and the claims contain a plurality of features in combination. Someone skilled in the art will purposefully also consider the features separately and will find further expedient combinations.

Figure 2:
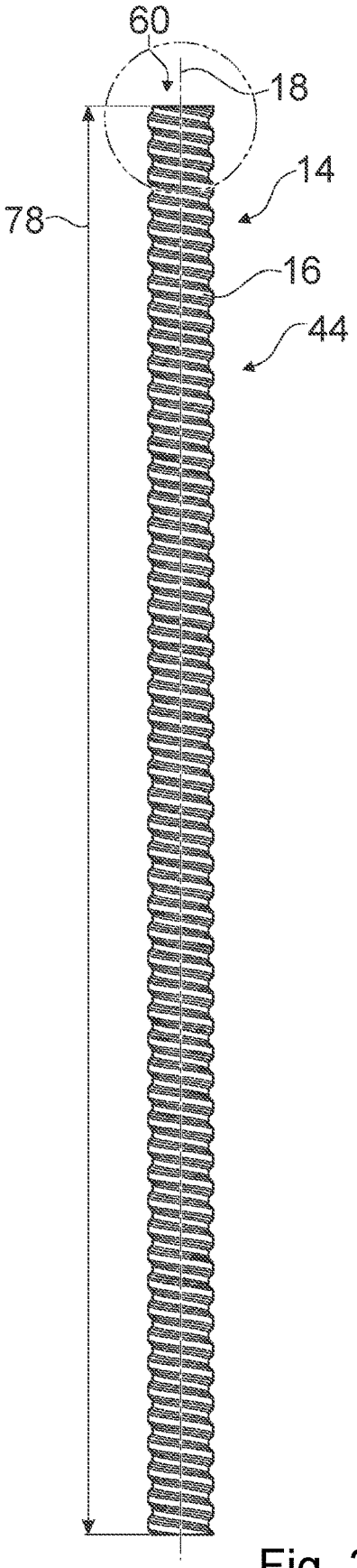
Figure 3:
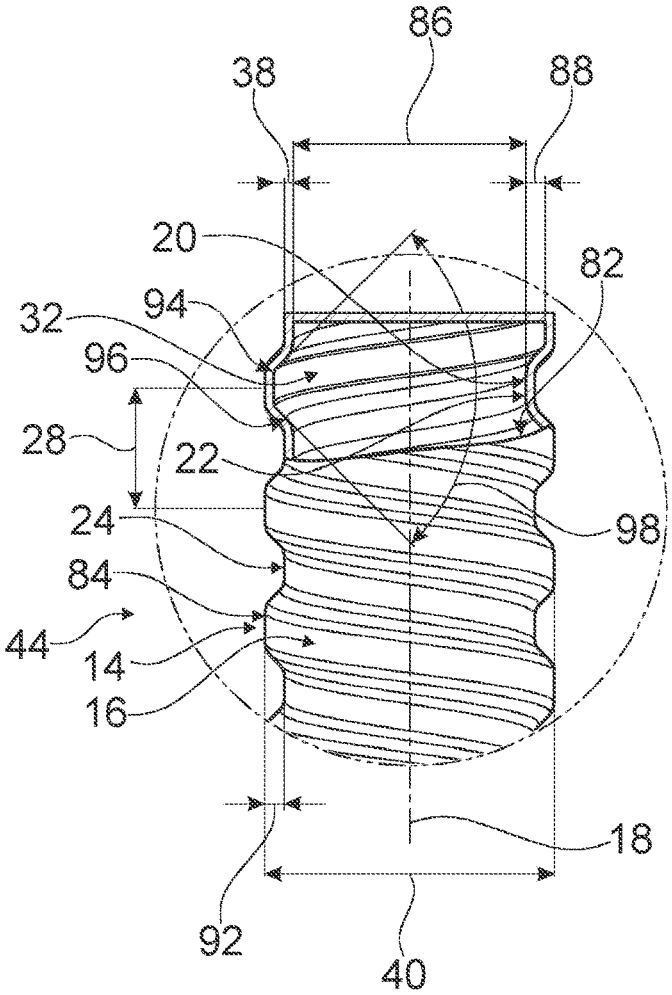
Figure 4:
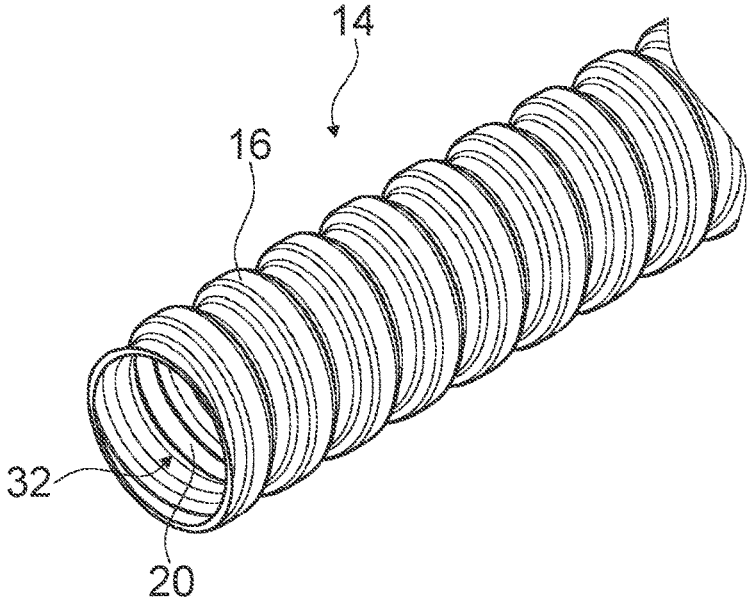
Figure 5:
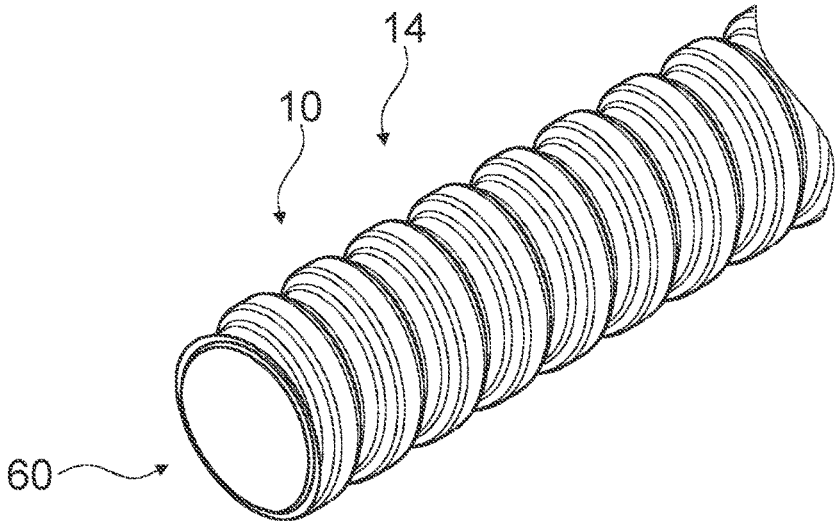
Figure 6:
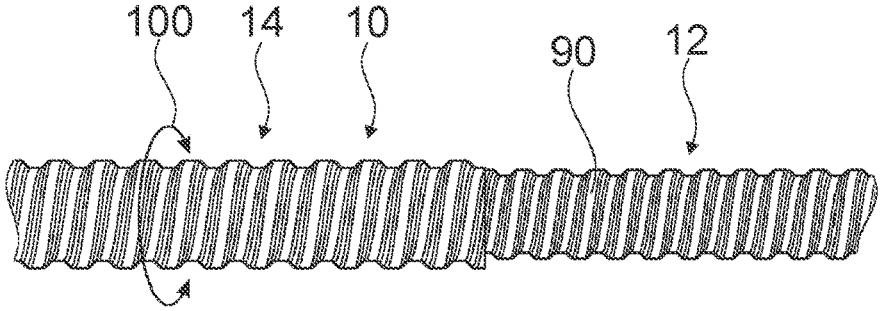
Figure 7:
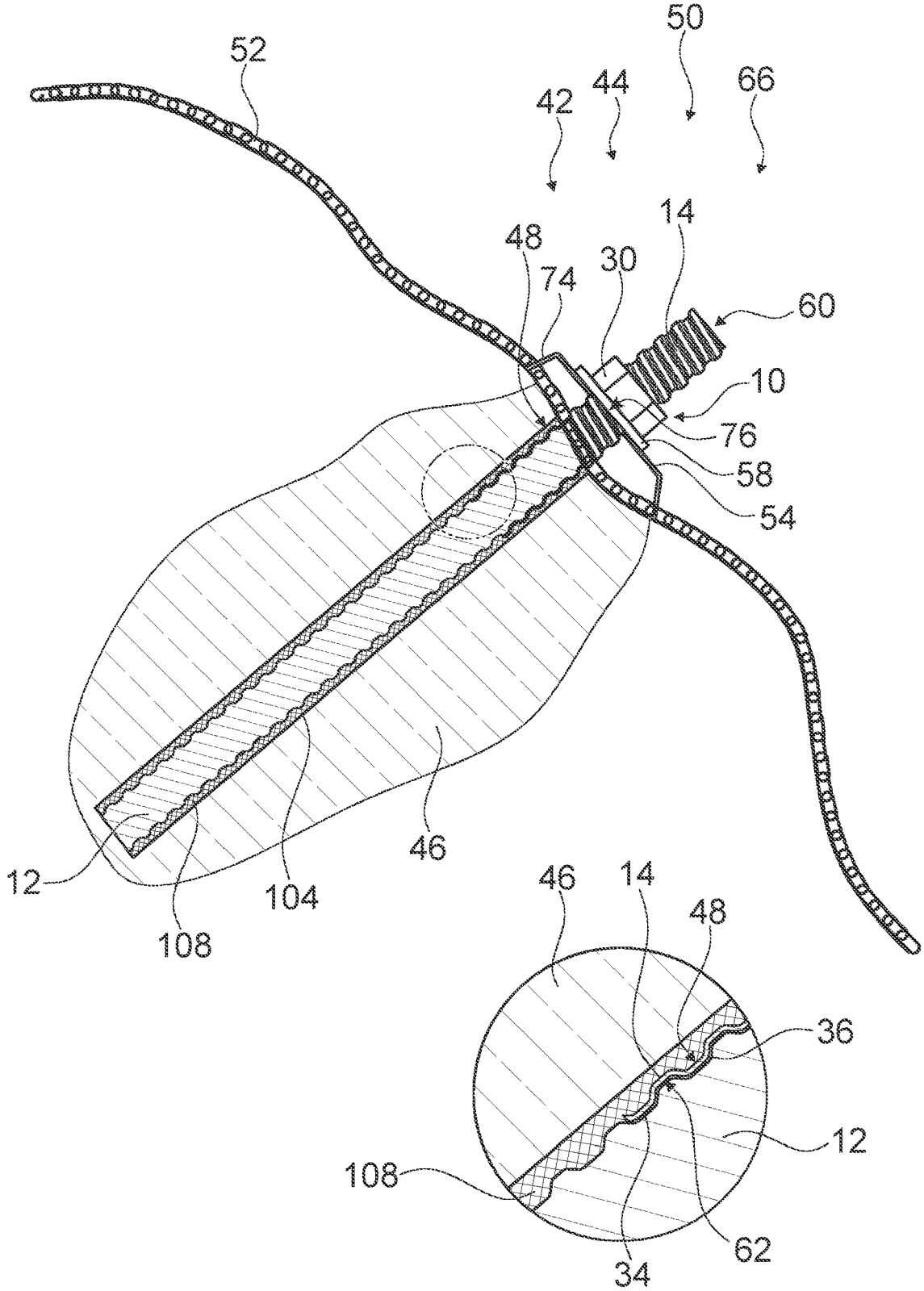
Figure 8:
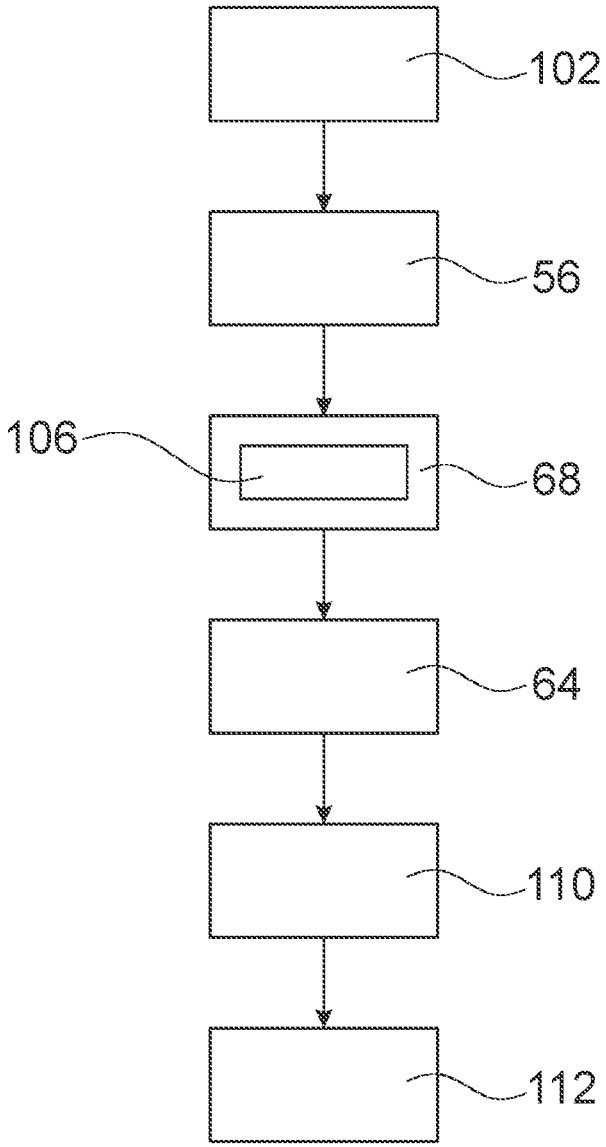

It is shown in:

FIG. 1 a schematic view of a portion of a corrosion-protected embankment stabilization system with a corrosion protection system comprising a corrosion protection device, FIG. 2 a schematic side view of a sleeve element of the corrosion protection device, FIG. 3 a schematic illustration of a section-wise cut portion of the sleeve element, FIG. 4 a schematic perspective view of a first side (underside) of the sleeve element, FIG. 5 a schematic perspective view of a second side (upper side) of the sleeve element, FIG. 6 a further schematic side view of a portion of the sleeve element in a state when screwed onto a geotechnical anchor element of the embankment stabilization system, FIG. 7 a schematic sectional view of the embankment stabilization system with the corrosion protection system that comprises the corrosion protection device, and FIG. 8 a schematic flow chart of a method for a corrosion-protected anchoring of the geotechnical anchor element.

DESCRIPTION OF THE EXEMPLARY EMBODIMENT

FIG. 1 shows a schematic view of a portion of a corrosion-protected embankment stabilization system 50. The embankment stabilization system 50 is spread across a ground 46. The embankment stabilization system 50 protects an environment of the ground 46 from erosion. The embankment stabilization system 50 comprises a wire netting 52. The wire netting 52 is made of high-tensile steel wire. The high-tensile steel wire of the wire netting 52 has a tensile strength of at least 800 N/mm$^2$, preferably of at least 1,000 N/mm$^2$ and preferentially of at least 1,500 N/mm$^2$. The high-tensile steel wire of the wire netting 52 has a tensile strength of maximally 3,000 N/mm$^2$, preferably of maximally 2,500 N/mm$^2$ and preferentially of maximally 2,000 N/mm$^2$. The wire netting 52 has a stainless steel surface. The wire netting 52 is made of a stainless steel. The wire netting 52 is configured to be spread two-dimensionally across a surface of the ground 46, for example across an embankment, a rockwall or the like.

The embankment stabilization system 50 comprises a clamping plate 54. The clamping plate 54 lies upon the wire netting 52. The clamping plate 54 is configured for retaining the wire netting 52 on the ground 46. The clamping plate 54 is configured for pressing the wire netting 52 to the ground 46. The clamping plate 54 is configured to span over several meshes 72 of the wire netting 52. The clamping plate 54 is exemplarily realized as a spike plate configured to engage in several meshes 72 of the wire netting 52. For an engagement in the meshes 72 of the wire netting 52, the clamping plate 54 that is embodied as a spike plate comprises several claw elements 74, which are angled towards the ground 46. Alternatively, the clamping plate 54 may as well be realized as an at least substantially planar plate without claw elements 74. The clamping plate 54 is made of a high-tensile steel but may alternatively also be made of a steel that is not high-tensile. The clamping plate 54 is realized in a monolithic fashion. The clamping plate 54 is made of a stainless steel. The clamping plate 54 has a central opening 76 for receiving at least one geotechnical anchor element 12 (see also FIG. 7) of the embankment stabilization system 50. The geotechnical anchor element 12 is made of a corrosion-sensitive metal or of a corrosion-sensitive metal alloy. The geotechnical anchor element 12 is made of a construction steel. The embankment stabilization system 50 comprises a sleeve element 14. The sleeve element 14 is put over the geotechnical anchor element 12 in an end region 10 of the geotechnical anchor element 12.

The embankment stabilization system 50 comprises a nut 30. The nut 30 is configured to retain the clamping plate 54 in the state of being pressed to the ground 46. The nut 30 is made of a stainless steel. The nut 30 is screwed onto the geotechnical anchor element 12 which has been threaded into the central opening 76 of the clamping plate 54, more precisely onto the sleeve element 14 encompassing the geotechnical anchor element 12. The sleeve element 14 is designed for a force transfer between the nut 30 that is screwed onto an outer thread 16 of the sleeve element 14 and the geotechnical anchor element 12. By the screwing-on of the nut 30, the nut 30 is pressed against the clamping plate 54, which is in its turn pressed against the ground 46 and against the wire netting 52 in a longitudinal direction 80 of the geotechnical anchor element 12. By means of the fastening method described, the wire netting 52 is fastened on the ground 46 in a positionally fixed manner. The embankment stabilization system 50 optionally comprises a washer 58 which is, in the mounted state of the embankment stabilization system 50, arranged between the nut 30 and the clamping plate 54. The embankment stabilization system 50 comprises a corrosion protection system 42. The corrosion protection system 42 is anchored in the ground 46. The corrosion protection system 42 is configured to form a corrosion protection for the geotechnical anchor element 12. The corrosion protection system 42 comprises a corrosion protection device 44.

FIG. 2 shows a schematic side view of the corrosion protection device 44. The corrosion protection device 44 comprises the sleeve element 14. The corrosion protection device 44, in particular the sleeve element 14, forms a corrosion protection adapter for the geotechnical anchor element 12. The corrosion protection device 44, in particular the sleeve element 14, is configured for a protection of the end region 10 of the geotechnical anchor element 12 against corrosion. The sleeve element 14 is configured to encompass the end region 10 of the geotechnical anchor element 12 in the circumferential direction of the geotechnical anchor element 12. The sleeve element 14 is configured for a closure of the encompassment of the end region 10 of the geotechnical anchor element 12 in the longitudinal direction 80 of the geotechnical anchor element 12. The sleeve element 14 is configured for a mounting on the geotechnical anchor element 12 such that the end region 10 of the geotechnical anchor element 12 is encompassed in the circumferential direction of the geotechnical anchor element 12. The sleeve element 14 is configured for a mounting on the geotechnical anchor element 12 such that the end region 10 of the geotechnical anchor element 12 is closed in the longitudinal direction 80. The sleeve element 14 is embodied as a cap that is closed in a longitudinal direction 18 of the sleeve element 14. On a front face 60 of the sleeve element 14, the sleeve element 14 forms an abutment for the geotechnical anchor element 12. The longitudinal direction 18 of the sleeve element 14 and the longitudinal direction 80 of the geotechnical anchor element 12 are in the mounted state of the sleeve element 14 oriented parallel to each other.

The sleeve element 14 is made of a corrosion-resistant metal. The sleeve element 14 is made of a stainless steel. The sleeve element 14 is realized in a one-part implementation. The sleeve element 14 is realized in a monolithic fashion. The sleeve element 14 is realized as a prefabricated component which is implemented separately from the geotechnical anchor element 12. The sleeve element 14 comprises the outer thread 16. The outer thread 16 is configured for the nut 30 to be screwed thereon (see FIG. 1). The outer thread 16 extends over an entire longitudinal extent 78 of the sleeve element 14. The outer thread 16 is constant over the entire longitudinal extent 78 of the sleeve element 14. The longitudinal extent 78 of the sleeve element 14 shown exemplarily in FIG. 2 amounts to 700 mm.

FIG. 3 shows schematically a section-wise cut portion of the sleeve element 14. The outer thread 16 has a thread pitch 28. The outer thread 16 is embodied as a (rounded) trapezoid thread. The outer thread 16 is embodied as a thread with a coarse thread pitch 28 of more than 5 mm. In the case of the sleeve element 14 shown in FIG. 3 by way of example, the thread pitch 28 of the outer thread 16 is approximately 13 mm. The sleeve element 14 is preferably free of further outer threads, i. e. of further outer thread turns.

The sleeve element 14 comprises an inner space 32. The sleeve element 14 is realized so as to be hollow in its interior (see also FIG. 4). The sleeve element 14 is embodied as a cap that is closed on one side in the longitudinal direction 18 of the sleeve element 14 (see FIG. 5). The sleeve element 14 has an inner thread 20. The inner thread 20 is arranged in the interior space 32 of the sleeve element 14. The inner thread 20 has a thread pitch 28. The thread pitches 28 of the inner thread 20 and of the outer thread 16 are identical to each other. The inner thread 20 is embodied as a (rounded) trapezoid thread. The (rounded) trapezoid thread has thread flanks 94, 96, which together span a flank angle 98. The flank angle 98 is approximately 90°. The inner thread 20 is embodied as a thread with a coarse thread pitch 28 of more than 5 mm. In the case of the sleeve element 14 that is shown in FIG. 3 by way of example, the thread pitch 28 of the inner thread 20 is approximately 13 mm. The sleeve element 14 is preferably free of further inner threads, i. e. free of further inner thread turns.

The sleeve element 14 has a wall thickness 38. In the case shown in FIG. 3 by way of example, the wall thickness 38 is approximately 1 mm. The inner thread 20 has a thread crest 22. A minimal inner diameter 86 of the sleeve element 14, formed by the thread crest 22 of the inner thread 20, is equivalent to less than a 30-fold of the wall thickness 38 of the sleeve element 14. In the case shown by way of example, the minimal inner diameter 86 is approximately 25.6 mm. The inner thread 20 has a thread groove 82. The inner thread 20 has a thread depth 88. The thread depth 88 of the inner thread 20 is more than a four-fold of the wall thickness 38. The thread depth 88 of the inner thread 20 is less than a ten-fold of the wall thickness 38. In the case shown in FIG. 3 by way of example, the thread depth amounts to approximately 4.3 mm.

The outer thread 16 has a thread crest 84. A maximal outer diameter 40 of the sleeve element 14, formed by the thread crest 84 of the outer thread 16, is equivalent to more than a 30-fold of the wall thickness 38 of the sleeve element 14. The maximal outer diameter 40 of the sleeve element 14, formed by the thread crest 84 of the outer thread 16, is equivalent to less than a 40-fold of the wall thickness 38 of the sleeve element 14. In the case shown by way of example, the maximal outer diameter 40 amounts to approximately 31.9 mm. The outer thread 16 has a thread groove 24. The outer thread 16 has a thread depth 92. The thread depth 92 of the outer thread 16 is more than a four-fold of the wall thickness 38. The thread depth 92 of the outer thread 16 is less than a ten-fold of the wall thickness 38. In the case shown in FIG. 3 by way of example, the thread depth 92 of the outer thread 16 is approximately 4.3 mm. The thread depths 88, 92 of the inner thread 20 and the outer thread 16 are approximately identical. The thread crest 22 of the inner thread 20 of the sleeve element 14 at the same time forms the thread groove 24 of the outer thread 16 of the sleeve element 14. The wall thickness 38 is thus equivalent to at least 2.5% of the maximal outer diameter 40 of the sleeve element 14.

FIG. 6 shows a schematic view of the sleeve element 14 and the geotechnical anchor element 12. The geotechnical anchor element 12 comprises an outer thread 90. The sleeve element 14 can be mounted onto the geotechnical anchor element 12. The sleeve element 14 can be screwed onto the geotechnical anchor element 12. The inner thread 20 of the sleeve element 14 can be screwed onto the outer thread 90 of the geotechnical anchor element 12. The sleeve element 14 can be screwed onto the geotechnical anchor element 12 without a tool (see in FIG. 6 the arrow 100 indicating screwing-on and screwing-off directions).

FIG. 7 shows a schematic sectional view of the embankment stabilization system with the corrosion protection system 42 comprising the corrosion protection device 44, wherein the geotechnical anchor element 12, in particular the corrosion protection system 42, is sunk into the ground 46 along the longitudinal direction 18 of the geotechnical anchor element 12. The corrosion protection system 42 comprises the sleeve element 14. The sleeve element 14 is mounted on the geotechnical anchor element 12. The corrosion protection device 44 is mounted on the geotechnical anchor element 12 in such a way that interstices 62 (see the enlarged section of a portion of the corrosion protection system 42 in FIG. 7) between the sleeve element 14 and the geotechnical anchor element 12 are closed towards the environment 66 in a water-tight manner. The inner space 32 of the sleeve element 14 is filled at least partially with a deformable sealing mass 34. The interstice 62 of the corrosion protection system 42 between the geotechnical anchor element 12 and the sleeve element 14 screwed onto the geotechnical anchor element 12 is filled with the deformable sealing mass 34. The inner space 32 of the sleeve element 14 is filled at least partially with a deformable adhesive mass 36. The interstice 62 of the corrosion protection system 42 between the geotechnical anchor element 12 and the sleeve element 14 screwed onto the geotechnical anchor element 12 is filled with the deformable adhesive mass 36.

The sleeve element 14 is mounted on the geotechnical anchor element 12 in such a way that, in a state when the geotechnical anchor element 12 is anchored in the ground 46 (for example in the states shown in FIGS. 1 and 7), a subregion 48 of the sleeve element 14 is also sunk in the ground 46. The geotechnical anchor element 12 is mortared in. The geotechnical anchor element 12 is surrounded by mortar 108. The sleeve element 14 is mounted on the geotechnical anchor element 12 in such a way that, in the state when the geotechnical anchor element 12 is anchored in the ground 46 (for example in the states shown in FIGS. 1 and 7), the subregion 48 of the sleeve element 14 is mortared in the ground 46 together with the geotechnical anchor element 12. In the anchored/mortared-in state of the geotechnical anchor element 12, at least a third of the total length extent 78 of the sleeve element 14 is arranged so as to be sunk in the ground 46. In the anchored/mortared-in state of the geotechnical anchor element 12, the sleeve element 14 extends from the end region of the geotechnical anchor element 12, which is situated outside (above the ground 46), as far as a subregion 48 of the geotechnical anchor element 12, which is situated within (below the ground 46). In the subregion 48 the sleeve element 14 is surrounded by the mortar 108. In order to ensure tight closure of an open side of the sleeve element 14 (see also FIG. 4), the sleeve element 14 that is screwed onto the geotechnical anchor element 12 is partially also mortared/sunk in the ground 46.

FIG. 8 shows a schematic flow chart of a method for corrosion-protected anchoring of the geotechnical anchor element 12 that is made of a corrosion-sensitive metal or of a corrosion-sensitive metal alloy. In at least one method step 102 an anchor borehole 104 is drilled into the ground 46. In at least one further method step 56 the sleeve element 14, which is made at least largely of the corrosion-resistant metal and comprises the outer thread 16, is mounted in the end region 10 of the geotechnical anchor element 12. In the method step 56 the sleeve element 14 is screwed onto the outer thread 90 of the geotechnical anchor element 12. In at least one further method step 68 the geotechnical anchor element 12 is brought into the ground 46 in such a way that at least a subregion 48 of the sleeve element 14 mounted on the geotechnical anchor element 12 is sunk into the ground 46. In at least one substep 106 of the method step 68, the geotechnical anchor element 12 is inserted into the anchor borehole 104. Before or after an insertion of the geotechnical anchor element 12 into the anchor borehole 104, the sleeve element 14 is screwed onto the geotechnical anchor element 12 in such a way that the sleeve element 14 covers the end region 10 of the geotechnical anchor element 12, which protrudes from the ground 46. Before or after an insertion of the geotechnical anchor element 12 into the anchor borehole 104, the sleeve eleent 14 is screwed onto the geotechnical anchor element 12 in such a way that the sleeve element 14 partially protrudes into the anchor borehole 104 when the geotechnical anchor element 12 has reached its anchoring position in the ground 46. In the mounted state at least a third of the total longitudinal extent 78 of the sleeve element 14 is situated within the anchor borehole 104. Alternatively to a screwing-on of the sleeve element 14 onto the geotechnical anchor element 12 after the insertion of the geotechnical anchor element 12 into the anchor borehole 104, it is also conceivable that the sleeve element 14 is already pre-mounted on the geotechnical anchor element 12 outside the anchor borehole 104. In at least one further method step 64 the sleeve element 14 is closed towards an environment 66 in a humidity-tight manner. In order to achieve the humidity-tight closure, at least a portion of the subregion 48 of the sleeve element 14 which protrudes into the anchor borehole 104, in particular the entire section of the sleeve element 14 which protrudes into the anchor borehole 104, is mortared into the ground 46, in particular into the anchor borehole 104, together with the geotechnical anchor element 12. In at least one further method step 110 the wire netting 52 and/or the clamping plate 54 are/is put over the geotechnical anchor element 12. In at least one further method step 112 the nut 30 is screwed onto the sleeve element 14 which encompasses the end region 10 of the geotechnical anchor element 12. In the method step 112 the nut 30 is screwed onto the sleeve element 14 in such a way that the clamping plate 54 is firmly pressed against the ground 46 and/or against the wire netting 52. After completion of the installation process described, only corrosion-protected elements of the embankment stabilization system 50, in particular elements of the embankment stabilization system 50 which are made of stainless steel, are exposed to the environment 66, i. e. to the atmosphere surrounding the embankment stabilization system 50.

The invention claimed is:

1. A corrosion-protected embankment stabilization system comprising:

a wire netting made of high-tensile steel, a clamping plate, a nut, a geotechnical anchor element comprising a corrosion-sensitive metal or a corrosion-sensitive metal alloy, and a corrosion protection adapter comprising:

a sleeve element which is configured for a mounting on the geotechnical anchor element such that the sleeve element encompasses a end region of the geotechnical anchor element at least in a circumferential direction of the geotechnical anchor element, wherein the sleeve element is made of a corrosion-resistant metal and comprises at least an outer thread, the sleeve element is a cap that is partially or completely closed in a longitudinal direction of the sleeve element, wherein the sleeve element with the outer thread is a prefabricated component, wherein the clamping plate is threaded onto the geotechnical anchor element that is anchored in the ground and furnished with the sleeve element, and wherein the nut is configured to screw onto the sleeve element, thereby pressing the clamping plate onto the wire netting in a longitudinal direction of the geotechnical anchor element such that the wire netting is fastened on the ground in an at least substantially positionally fixed manner.

2. The embankment stabilization system according to claim 1, wherein the sleeve element comprises an inner thread.

3. The embankment stabilization system according to claim 2, wherein a thread crest of the inner thread at the same time forms a thread groove of the outer thread.

4. The embankment stabilization system according to claim 1, wherein the outer thread comprises a coarse thread pitch of more than 5 mm.

5. The embankment stabilization system according to claim 1, wherein the sleeve element is designed for a force transfer between the nut that is screwed onto the outer thread of the sleeve element and the geotechnical anchor element.

6. The embankment stabilization system according to claim 1, wherein the sleeve element is made of a stainless steel.

7. The embankment stabilization system according to claim 1, wherein the sleeve element is realized in a one-part implementation.

8. The embankment stabilization system according to claim 1, wherein an inner space of the sleeve element is at least partially filled with a deformable sealing mass.

9. The embankment stabilization system according to claim 1, wherein an inner space of the sleeve element is at least partially filled with a deformable adhesive mass.

10. The embankment stabilization system according to claim 1, wherein the sleeve element is realized separately from the geotechnical anchor element and mountable onto the geotechnical anchor element without a tool.

11. The embankment stabilization system according to claim 1, wherein the sleeve element has a wall thickness that is equivalent to at least 1.2% of a maximal outer diameter of the sleeve element.

12. The embankment stabilization system according to claim 1, wherein the corrosion protection adapter is mounted on the geotechnical anchor element in such a way that interstices between the sleeve element and the geotechnical anchor element are closed toward an environment in a water-tight manner and/or filled with a deformable sealing mass and/or with a deformable adhesive mass.

13. The embankment stabilization system according to claim 1, wherein the sleeve element is mounted on the geotechnical anchor element in such a way that, in a state of the geotechnical anchor element being anchored in a ground, a subregion of the sleeve element is sunk in the ground.

14. The embankment stabilization system according to claim 13, wherein in the anchored state of the geotechnical anchor element, at least a third of a total longitudinal extent of the sleeve element is arranged so as to be sunk in the ground.

15. The corrosion-protected embankment stabilization system according to claim 1, wherein the clamping plate, the nut and/or the wire netting have/has at least a stainless steel surface or are/is completely made of a stainless steel, the geotechnical anchor element being made of a corrosion-sensitive metal or of a corrosion-sensitive metal alloy.

16. A method for an installation of a corrosion-protected embankment stabilization system according to claim 1, the method comprising:

mounting the sleeve element, which is made of a corrosion-resistant metal and which comprises the outer thread, on the end region of the geotechnical anchor element, closing the sleeve element toward an environment in a humidity-tight manner, sinking and mortaring the geotechnical anchor element into a ground in such a way that at least a subregion of the sleeve element that is mounted on the geotechnical anchor element is sunk into the ground, putting the wire netting and the clamping plate over the geotechnical anchor element, and screwing the nut onto the sleeve element which encompasses the end region of the geotechnical anchor element in such a way that the clamping plate is firmly pressed against the ground and/or against the wire netting.

* * * * *